US011403945B2

(12) United States Patent
Oh

(10) Patent No.: US 11,403,945 B2
(45) Date of Patent: Aug. 2, 2022

(54) INTERSECTION SIGNAL PREDICTION SYSTEM AND METHOD THEREOF

(71) Applicants: Hyundai Motor Company, Seoul (KR); Kia Motors Corporation, Seoul (KR)

(72) Inventor: Yoan Oh, Gyeonggi-do (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 186 days.

(21) Appl. No.: 16/848,422

(22) Filed: Apr. 14, 2020

(65) Prior Publication Data

US 2021/0174677 A1 Jun. 10, 2021

(30) Foreign Application Priority Data

Dec. 6, 2019 (KR) ..... 10-2019-0161640

(51) Int. Cl.

| | |
|---|---|
| ***G08G 1/09*** | (2006.01) |
| ***G08G 1/0967*** | (2006.01) |
| ***G08G 1/052*** | (2006.01) |
| ***G08G 1/095*** | (2006.01) |

(52) U.S. Cl.

CPC ..... *G08G 1/096783* (2013.01); *G08G 1/052* (2013.01); *G08G 1/095* (2013.01)

(58) Field of Classification Search

CPC .. G08G 1/096783; G08G 1/052; G08G 1/095; G08G 1/0112; G08G 1/0133; G08G 1/0141; G08G 1/096716; G08G 1/096725; G08G 1/096741; G08G 1/096791; G08G 1/08; G08G 1/09623; G08G 1/096775; G08G 1/081; G08G 1/0125; G08G 1/0137; G08G 1/097

USPC ..... 340/905, 915, 990, 988, 995.1

See application file for complete search history.

(56) References Cited

U.S. PATENT DOCUMENTS

| | | | | |
|---|---|---|---|---|
| 9,558,660 | B1 * | 1/2017 | Fowe | G08G 1/0133 |
| 2005/0119826 | A1 * | 6/2005 | Lee | G08G 1/096861 701/437 |
| 2015/0054658 | A1 * | 2/2015 | Kosatka-Pioro | G08G 1/096783 340/905 |
| 2015/0262483 | A1 * | 9/2015 | Sugawara | G08G 1/096783 340/929 |
| 2018/0301026 | A1 * | 10/2018 | Yudanov | G08G 1/0116 |

(Continued)

*Primary Examiner* — Anh V La

(74) *Attorney, Agent, or Firm* — Fox Rothschild LLP

(57) ABSTRACT

An intersection signal prediction system includes a first telematics terminal in a first vehicle configured to output a driving path toward a destination of the first vehicle and a second telematics terminal in a second vehicle driving in an intersection direction along the driving path of the first vehicle at a distance equal to or less than a preset distance. The first telematics terminal transmits a signal requesting status information of a traffic light installed at the intersection to a telematics server. The telematics server transmits a signal requesting speed information of the second vehicle to the second telematics terminal in response to receiving the status signal from the first telematics terminal, to determine a state of the traffic light based on the speed information received from the second telematics terminal, and to transmit information about the state of the traffic light to the first telematics terminal.

18 Claims, 6 Drawing Sheets

(56) References Cited

U.S. PATENT DOCUMENTS

2019/0122548 A1* 4/2019 Sakuma ..... G08G 1/096741
2020/0286387 A1* 9/2020 Zhou ..... G08G 1/166

* cited by examiner

INTERSECTION SIGNAL PREDICTION SYSTEM AND METHOD THEREOF

CROSS-REFERENCE TO RELATED APPLICATION(S)

This application is based on and claims priority under 35 U.S.C. § 119 to Korean Patent Application No. 10-2019-0161640, filed on Dec. 6, 2019, the disclosure of which is incorporated by reference in its entirety.

TECHNICAL FIELD

The present disclosure relates to an intersection signal prediction system for predicting a signal of an intersection located on a driving path of a vehicle and providing the signal information of the intersection to a driver, and a method thereof.

BACKGROUND

Recently, with the development of a vehicle IT technology, there is an increasing number of vehicles equipped with a telematics system. Telematics is a compound word of telecommunication and informatics, and defined as a next-generation information providing service for vehicle through a combination of the IT industry and the automotive industry.

A telematics service for vehicles provides drivers with real time various services, such as vehicle accidents or theft detection, driving path guidance, traffic information, remote vehicle diagnostic services, financial services, games, etc. by combining mobile communication technology and global positioning system (GPS) with vehicles However, a telematics terminal for vehicle has only a navigation function for guiding a vehicle along an optimal driving path in real time, and does not have a function for providing guidance related to signal information of an intersection existing on the driving path.

SUMMARY

Therefore, the present disclosure provides an intersection signal prediction system capable of predicting a signal of an intersection existing on a driving path of a vehicle and providing guidance related to signal information of the intersection to a driver, and a method thereof. Additional aspects of the disclosure will be set forth in part in the description which follows and, in part, will be obvious from the description, or may be learned by practice of the disclosure.

In accordance with an aspect of the disclosure, an intersection signal prediction system may include a first telematics terminal mounted within a first vehicle, and configured to output a driving path toward a destination of the first vehicle; a second telematics terminal mounted within a second vehicle driving in an intersection direction when a distance from an intersection existing on the driving path of the first vehicle is equal to or less than a preset distance; and a telematics server configured to communicate with the first telematics terminal and the second telematics terminal.

The first telematics terminal may be configured to transmit a signal for requesting status information of a traffic light installed at the intersection located along the driving path to the telematics server. The telematics server may be configured to transmit a signal for requesting speed information of the second vehicle to the second telematics terminal in response to receiving the signal for requesting the status information of the traffic light installed at the intersection from the first telematics terminal, to determine a state of the traffic light installed at the intersection based on the speed information received from the second telematics terminal, and to transmit information regarding the state of the traffic light to the first telematics terminal.

When there is a database of status information of the traffic light installed at the intersection, the telematics server may be configured to transmit the status information of the traffic light installed at the intersection to the first telematics terminal based on information stored in the database. In particular, when a speed of the second vehicle is greater than or equal to a preset speed, the telematics server may be configured to determine the state of the traffic light installed at the intersection as a green light state. When the second vehicle stops before passing through the intersection, the telematics server may be configured to change the state of the traffic light to a red light state.

When a speed of the second vehicle is less than a preset speed, the telematics server may be configured to determine the state of the traffic light installed at the intersection based on an acceleration of the second vehicle. When the second vehicle decelerates, the telematics server may be configured to determine the state of the traffic light installed at the intersection as a red light state. When the second vehicle accelerates to have a speed greater than the preset speed, the telematics server may be configured to determine the state of the traffic light installed at the intersection as a green light state.

The telematics server may be configured to receive traffic information of the intersection from an external traffic information server, and determine the state of the traffic light installed at the intersection as an unknown state when the intersection corresponds to a congestion section. The telematics server may be configured to store information regarding the state of the traffic light in a database. The telematics terminal may be configured to output status information of the traffic light installed at the intersection received from the telematics server.

In accordance with another aspect of the disclosure, an intersection signal prediction method may include transmitting, by a first telematics terminal mounted within a first vehicle, a signal for requesting status information of a traffic light installed at an intersection located along a driving path of the first vehicle to a telematics server; receiving, by the telematics server, speed information of a second vehicle from a second telematics terminal mounted within a second vehicle driving in an intersection direction when a distance from an intersection located along the driving path of the first vehicle is equal to or less than a preset distance; determining, by the telematics server, a state of the traffic light installed at the intersection based on the speed information received from the second telematics terminal; and transmitting, by the telematics server, information regarding the state of the traffic light to the first telematics terminal.

When there is a database of status information of the traffic light installed at the intersection, the method may include transmitting, by the telematics server, the status information of the traffic light installed at the intersection to the first telematics terminal based on the database. The determining of the state of the traffic light installed at the intersection based on the speed information received from the second telematics terminal may include determining the state of the traffic light installed at the intersection as a green light state when a speed of the second vehicle is greater than or equal to a preset speed.

Additionally, the determining of the state of the traffic light installed at the intersection based on the speed information received from the second telematics terminal may include changing the state of the traffic light to a red light state when the second vehicle stops before passing through the intersection. The determining of the state of the traffic light installed at the intersection based on the speed information received from the second telematics terminal may include determining the state of the traffic light installed at the intersection based on an acceleration of the second vehicle when a speed of the second vehicle is less than a preset speed.

When the speed of the second vehicle is less than the preset speed, the determining of the state of the traffic light installed at the intersection based on an acceleration of the second vehicle may include determining the state of the traffic light installed at the intersection as a red light state when the second vehicle decelerates. In addition, when the speed of the second vehicle is less than the preset speed, the determining of the state of the traffic light installed at the intersection based on an acceleration of the second vehicle may include determining the state of the traffic light installed at the intersection as a green light state when the second vehicle accelerates to have a speed greater than the preset speed.

When the speed of the second vehicle is less than the preset speed, the determining of the state of the traffic light installed at the intersection based on an acceleration of the second vehicle may include receiving, by the telematics server, traffic information of the intersection from an external traffic information server; and when the intersection corresponds to a congestion section, determining the state of the traffic light installed at the intersection as an unknown state.

The intersection signal prediction method may further include storing, information regarding the state of the traffic light in a database of the telematics server. The intersection signal prediction method may further include outputting, by the telematics terminal, status information of the traffic light installed at the intersection received from the telematics server.

BRIEF DESCRIPTION OF THE DRAWINGS

These and/or other aspects of the disclosure will become apparent and more readily appreciated from the following description of the exemplary embodiments, taken in conjunction with the accompanying drawings of which.

DETAILED DESCRIPTION

Figure 1:
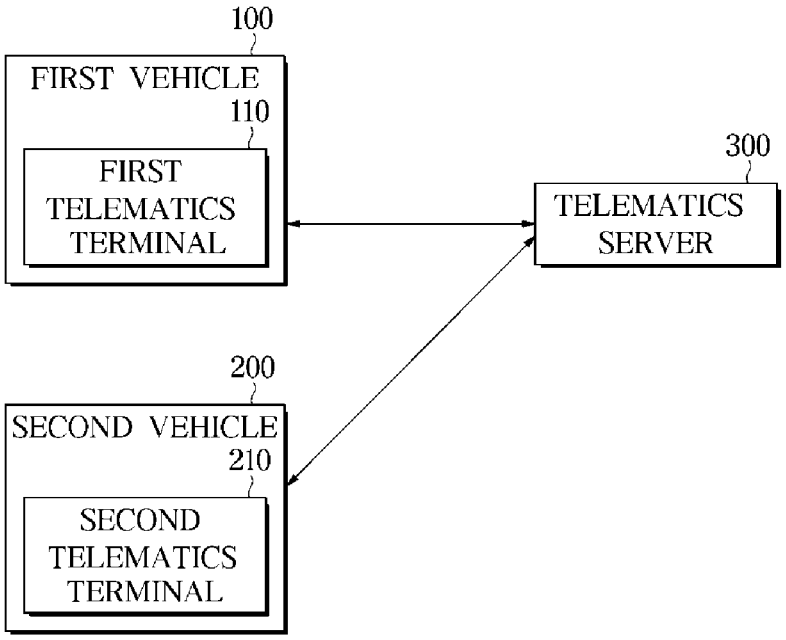
FIG. 1 is a block diagram illustrating a configuration of an intersection signal prediction system according to an exemplary embodiments of the present disclosure.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, combustion, plug-in hybrid electric vehicles, hydrogen-powered vehicles and other alternative fuel vehicles (e.g. fuels derived from resources other than petroleum).

Although exemplary embodiment is described as using a plurality of units to perform the exemplary process, it is understood that the exemplary processes may also be performed by one or plurality of modules. Additionally, it is understood that the term controller/control unit refers to a hardware device that includes a memory and a processor. The memory is configured to store the modules and the processor is specifically configured to execute said modules to perform one or more processes which are described further below.

Furthermore, control logic of the present disclosure may be embodied as non-transitory computer readable media on a computer readable medium containing executable program instructions executed by a processor, controller/control unit or the like. Examples of the computer readable mediums include, but are not limited to, ROM, RAM, compact disc (CD)-ROMs, magnetic tapes, floppy disks, flash drives, smart cards and optical data storage devices. The computer readable recording medium can also be distributed in network coupled computer systems so that the computer readable media is stored and executed in a distributed fashion, e.g., by a telematics server or a Controller Area Network (CAN).

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

Unless specifically stated or obvious from context, as used herein, the term "about" is understood as within a range of normal tolerance in the art, for example within 2 standard deviations of the mean. "About" can be understood as within 10%, 9%, 8%, 7%, 6%, 5%, 4%, 3%, 2%, 1%, 0.5%, 0.1%, 0.05%, or 0.01% of the stated value. Unless otherwise clear from the context, all numerical values provided herein are modified by the term "about."

The following description is merely exemplary in nature and is not intended to limit the present disclosure, application, or uses. It should be understood that throughout the drawings, corresponding reference numerals indicate like or corresponding parts and features. Moreover, terms described in the specification such as "part," "module," and "unit," refer to a unit of processing at least one function or operation, and may be implemented by software, a hardware component such as a field-programmable gate array (FPGA) or an application-specific integrated circuit (ASIC), or a combination of software and hardware.

However, the terms "part," "module," "unit," and the like are not limited to software or hardware. "Part," "module," "unit," and the like may be configured in a recording medium that can be addressed or may be configured to be reproduced on at least one processor. Therefore, examples of the terms "part," "module," "unit," and the like include software components, object-oriented software components, components such as class components and task components, processes, functions, properties, procedures, subroutines, segments in program codes, drivers, firmware, microcode, circuits, data, databases, data structures, tables, arrays, and variables. The components and the modules may be provided into smaller number of components and modules such that the respective component and modules may be merged in respect to the functionality.

Hereinafter, an intersection signal prediction system and a method thereof will be described in detail with reference to the accompanying drawings. In addition, parts irrelevant to description are omitted in the drawings in order to clearly explain some forms of the present disclosure.

FIG. 1 is a block diagram illustrating a configuration of an intersection signal prediction system according to exemplary embodiments of the disclosure. Referring to FIG. 1, an intersection signal prediction system according to an exemplary embodiment may include a first vehicle 100 including a first telematics terminal 110, a second vehicle 200 including a second telematics terminal 210, and a telematics server 300.

In particular, the first vehicle 100 may refer to a host or subject vehicle. The second vehicle 200 may refer to another vehicle that is located at a distance from an intersection located along a driving path of the host vehicle and the distance is less than or equal to a preset distance and the second vehicle is being driven an intersection direction (e.g., is being driven towards the intersection). In other words, the second vehicle may be considered to be driving ahead of the subject vehicle toward the same intersection as the subject vehicle. The first telematics terminal 110 and the second telematics terminal 210 may refer to terminals dedicated to telematics, and may be implemented in an integrated form in audio-video-navigation (AVN) devices of the first vehicle 100 and the second vehicle 200, respectively.

The telematics terminals 110 and 210 may include a communication modem to communicate with the telematics server 300. In particular, the communication modem may provide 4G communication functions such as long term evolution (LTE) as well as 2G or 3G communication functions. In other words, the telematics terminals 110 and 210 may be configured to communicate with the telematics server 300 connected to a mobile communication network via the communication modem. The telematics terminals 110 and 210 may be configured to transmit various data to the telematics server 300 and receive various data from the telematics server 300.

For example, the telematics terminals 110 and 210 may be configured to transmit position information of the current vehicles 100 and 200 to the telematics server 300 when a specific event occurs. The specific event may occur based on a moving distance or a moving time of the vehicles 100 and 200.

The communication modem provided in the telematics terminals 110 and 210 may include a module required for mobile communication. For example, various radio access systems such as code division multiple access (CDMA), frequency division multiple access (FDMA), time division multiple access (TDMA), orthogonal frequency division multiple access (OFDMA), single carrier frequency division multiple access (SCFDMA), and the like. The CDMA may be implemented with a radio technology such as universal terrestrial radio access (UTRA) or CDMA2000. The TDMA may be implemented with radio technologies such as global system for mobile communications (GSM)/general packet radio service (GPRS)/enhanced data rates for GSM evolution (EDGE).

The OFDMA may be implemented in the radio technology such as IEEE 802.11 (Wi-Fi), IEEE 802.16 (WiMAX), IEEE 802-20, evolved UTRA (E-UTRA), and the like. The UTRA is part of the universal mobile telecommunications system (UMTS). 3rd Generation Partnership Project (3GPP) LTE employs OFDMA on the downlink and SC-FDMA on the uplink as part of evolved UMTS (E-UMTS) using E-UTRA. LTE-advanced (LTE-A) is an evolved version of 3GPP LTE, which is called 4G communication to distinguish it from the 3G communication described above.

The communication modem provided in the telematics terminals 110 and 210 may not only provide 3G and 4G networks in accordance with the current standard communication standards, but may also provide functions required for more networks (e.g., including 5G networks, etc.) currently being discussed by the international standard organization. The communication modem provided in the telematics terminals 110 and 210 may be connected to an integrated antenna mounted on the vehicles 100 and 200, and may be configured to transmit and receive a wireless signal to and from the mobile communication network via the integrated antenna. The data processed by the communication modem may be transmitted to the telematics terminals 110 and 210 or to a mobile communication network connected via an integrated antenna.

In addition, the communication modem may also include an interface for communicating with a user terminal. In particular, the communication modem may be configured to communicate with the user terminal via Wi-Fi, Greentooth, etc., but is not limited thereto. The telematics terminals 110 and 210 may include a storage (not shown) configured to store various data necessary for an operation of the telematics terminals 110 and 210. The storage may be configured to store various applications necessary for providing an operating system or information necessary for driving the interface. The storage may include a control program for operating the telematics terminals 110 and 210 and a map database including control data, map data and load data for executing the operations of the telematics terminals 110 and 210, and destination information related to a destination entered by a user.

The storage may also be configured to store operation data generated while the telematics terminals 110 and 210 perform a predetermined operation. The storage may include at least one storage medium of a flash memory, a hard disk, a card type memory (e.g. SD or XD memory, etc.), a random access memory (RAM), a static random access memory (SRAM), a Read Only Memory (ROM), an electrically erasable programmable ROM (EEPROM), a programmable ROM (PROM), a magnetic memory, a magnetic disk, and an optical disk. In addition, the telematics terminals 110 and 210 may include a controller (not shown) configured to execute the overall operations of the telematics terminals 110 and 210. The controller may be configured to execute operations of various modules, devices, and the like embedded in the telematics terminals 110 and 210.

According to an exemplary embodiment, the controller may be operated by a processor embedded in the telematics terminals 110 and 210, and may be configured to generate a control signal for operating various modules, devices, etc. embedded in the telematics terminals 110 and 210. The operation of each component described above may be controlled. In addition, the controller may be configured to output music (audio) or an image according to a control command of the user terminal paired with the telematics terminals 110 and 210. When the user terminal is operated, the controller may be configured to output modules installed within the vehicle 100 or 200 using the information of the user terminal.

Further, the telematics terminals 110 and 210 may be configured to transmit and receive data with global positioning system (GPS) satellites to transmit and receive position information of the current vehicles 100 and 200 from the GPS satellites, or may be configured to transmit and receive map information from a server located at a remote location. The telematics terminals 110 and 210 may be configured to generate a driving path of the optimized vehicles 100 and 200 based on the destination, a current position, the map data, and the load data of the vehicles 100 and 200 (e.g., the first and second vehicles), and may be configured to provide a navigation function to provide guidance along the driving path to a driver.

The telematics terminals 110 and 210 may include a display configured to output various data. For example, the display of the telematics terminals 110 and 210 may be configured to display various information related to the driving paths and the driving paths of the vehicles 100 and 200. The telematics server 300 may be provided in a telematics center to communicate with the telematics terminals 110 and 210 via the mobile communication network.

The telematics server 300 may also include the map database that includes the map data and the road data. For example, the map database may include a database of status information of a traffic light 400 installed at the intersection. The telematics server 300 may be configured to receive position information, speed information based on a change in position, and the like of the vehicles 100 and 200 from the telematics terminals 110 and 210. In addition, the telematics server 300 may be configured to receive a destination of the vehicles 100 and 200, generate an optimal path based on the received destination, and transmit the generated path to the telematics terminals 110 and 210.

As will be described later, the telematics server 300 may be configured to transmit information regarding a state of the traffic light 400 installed at the intersection located along the driving paths of the vehicles 100 and 200 to the telematics terminals 110 and 210. In the above, each configuration of the intersection prediction signal system was described. Hereinafter, flowcharts of the intersection prediction signal system according to an exemplary embodiment will be described with reference to FIGS. 2 to 6.

Figure 2:
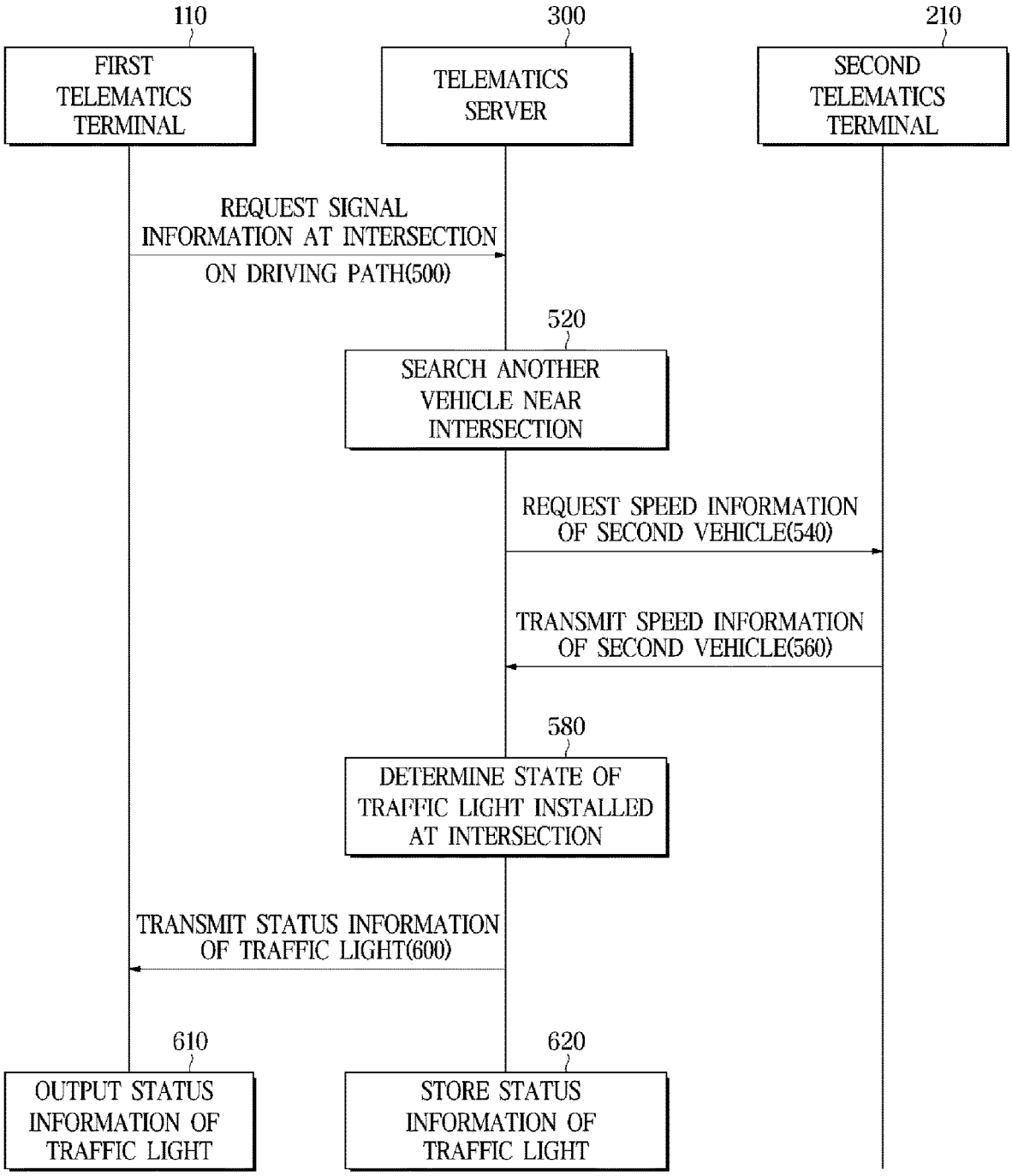
FIG. 2 is a flowchart of an intersection signal prediction system according to an exemplary embodiments of the present disclosure.
Figure 3:
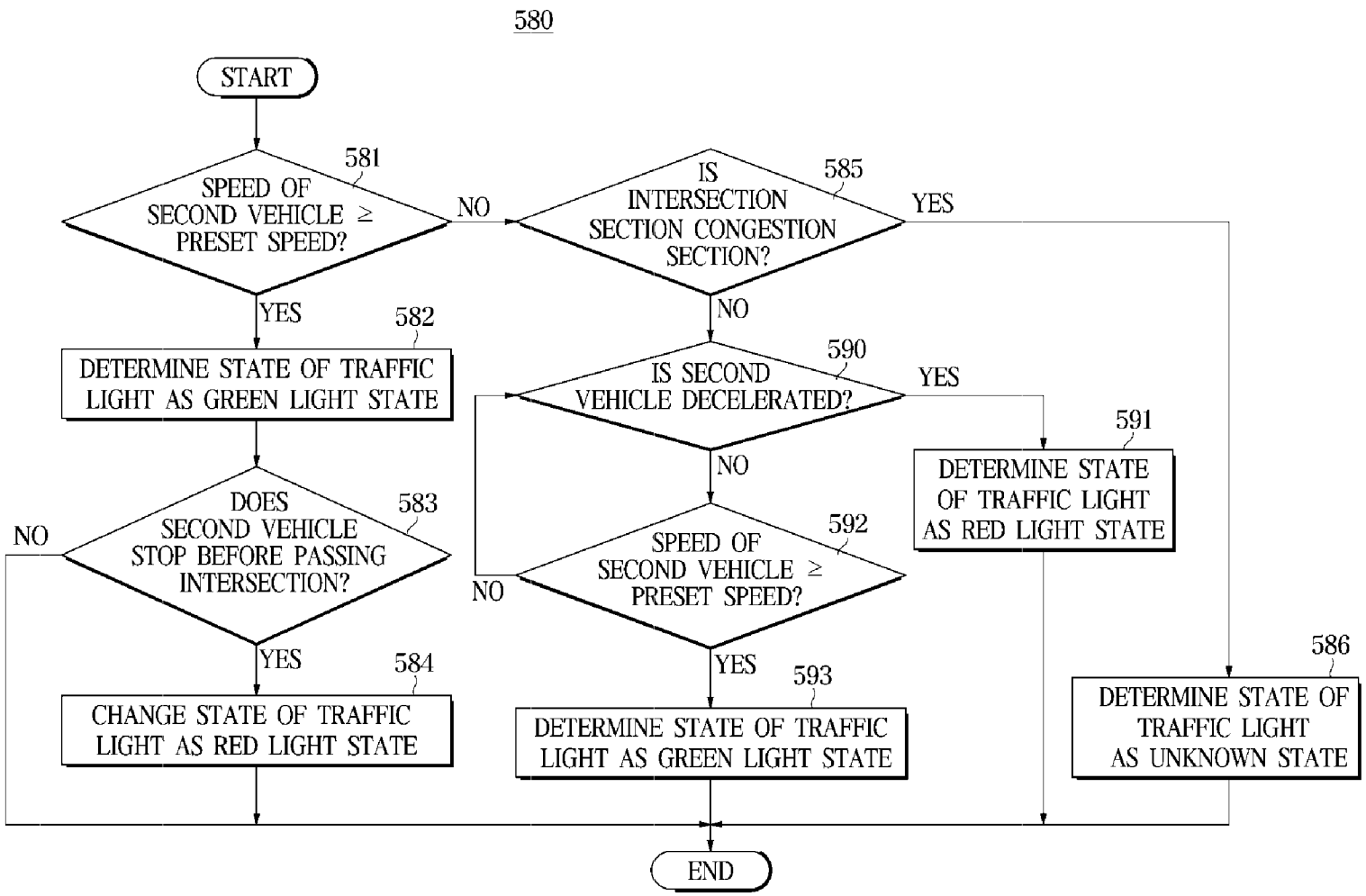
FIG. 3 is a flowchart illustrating a process of determining a state of a traffic light by a telematics server according to an exemplary embodiments of the present disclosure.
Figure 4:
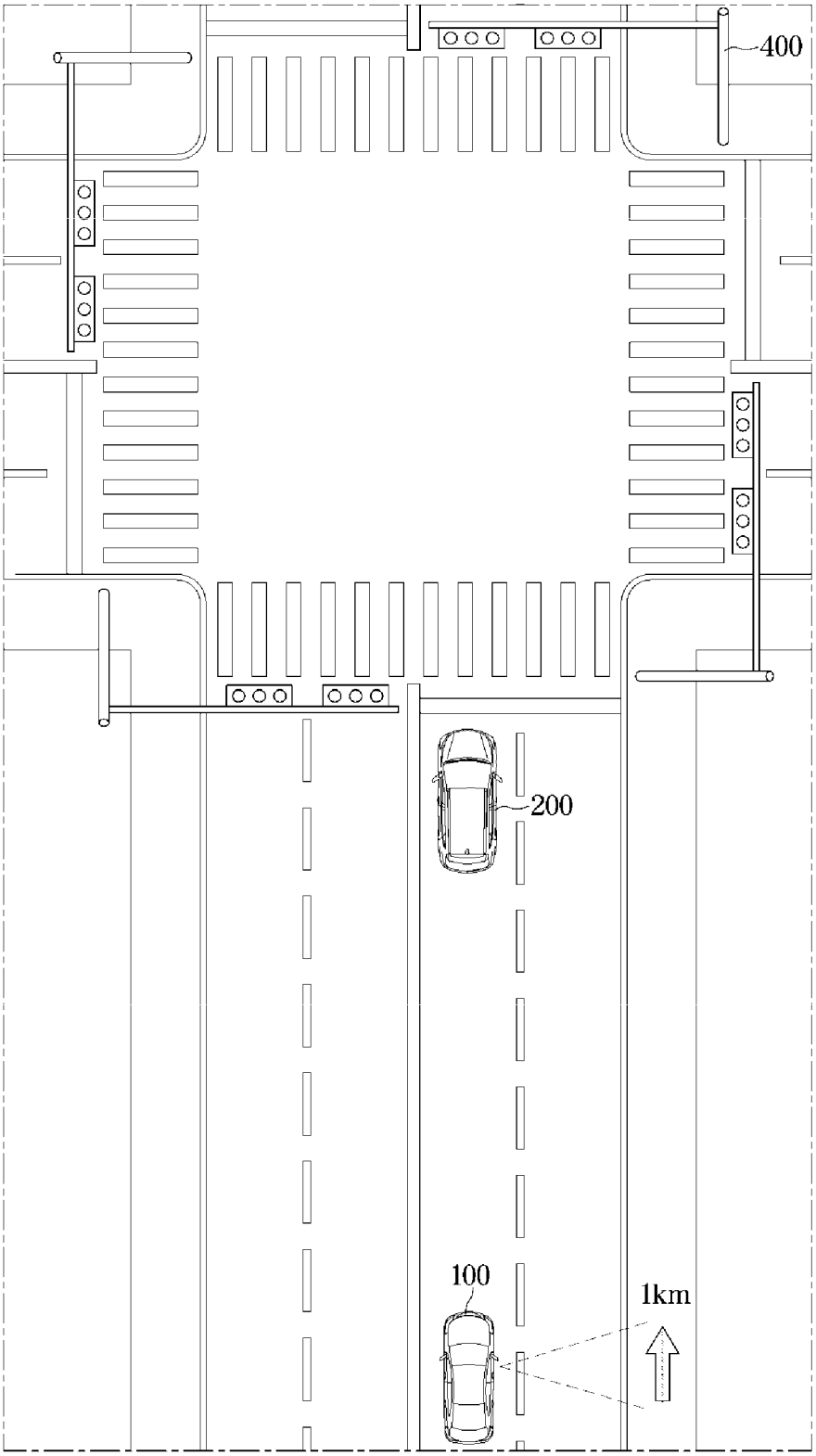
FIG. 4 is a view for describing a second vehicle adjacent to an intersection when there is the intersection on a driving path of a first vehicle, according to an exemplary embodiments of the present disclosure.
Figure 5:
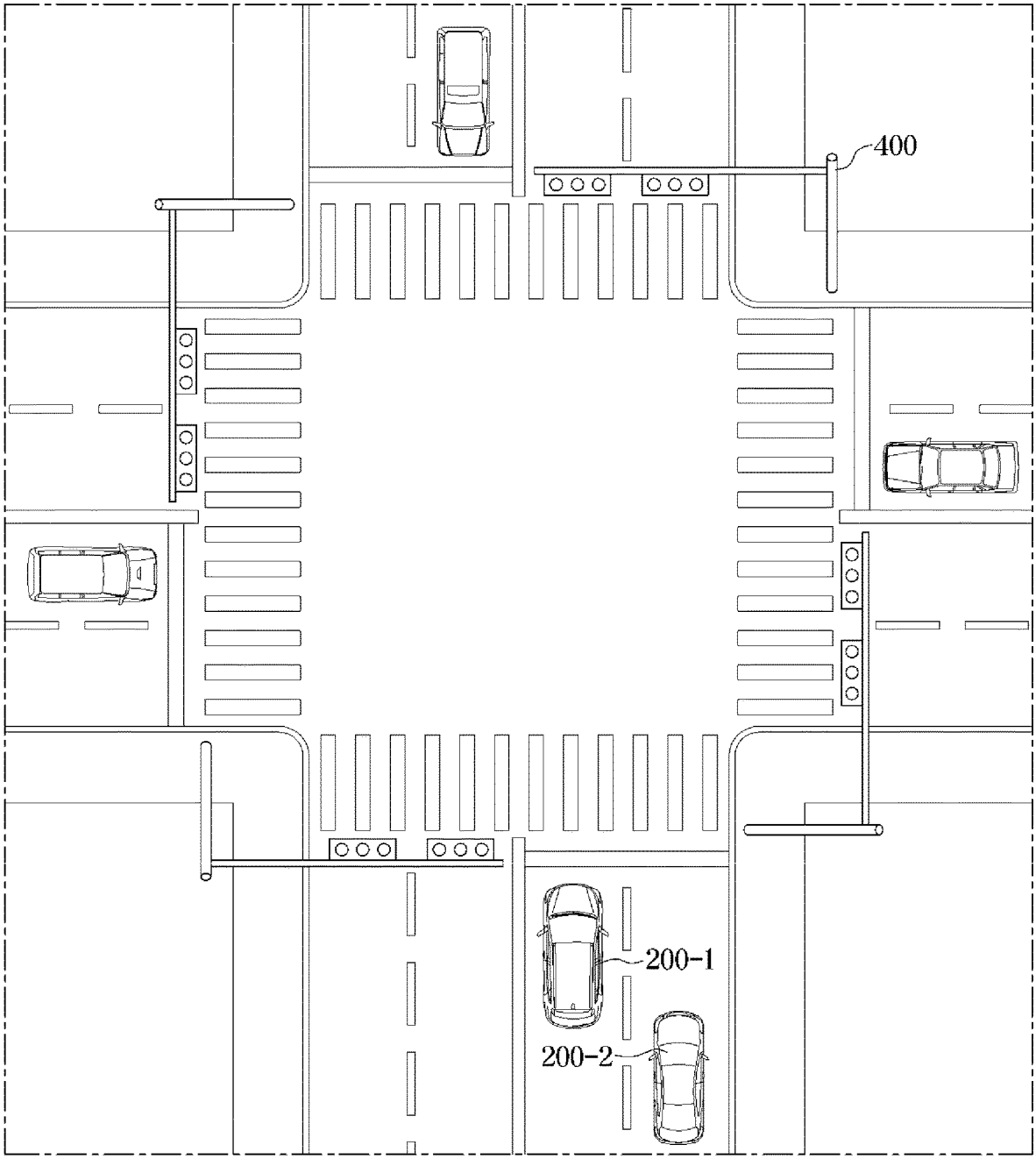
FIG. 5 is a view for describing a case in which a second vehicle is a plurality of vehicles, according to an exemplary embodiments of the present disclosure.
Figure 6:
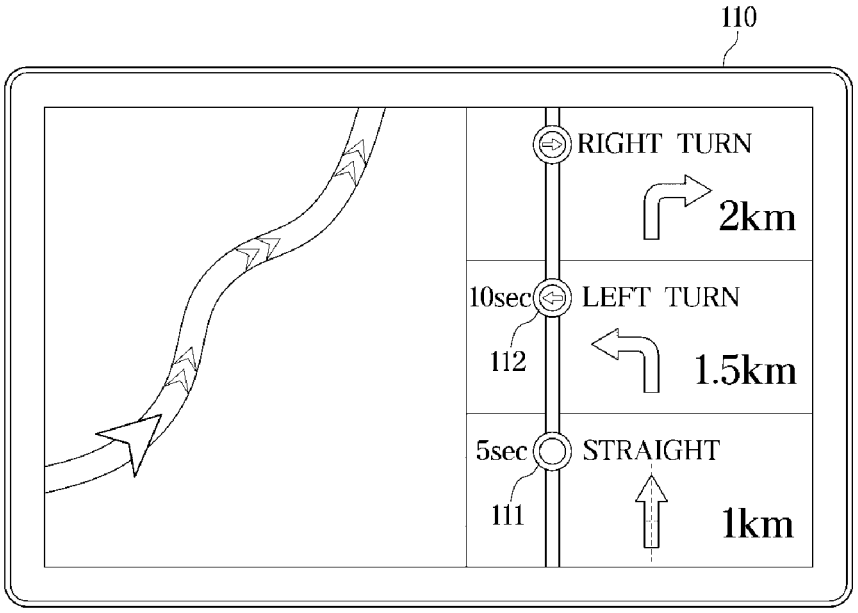
FIG. 6 is a view illustrating a display for outputting status information of a traffic light an exemplary embodiments of the present disclosure.

FIG. 2 is a flowchart of an intersection signal prediction system according to exemplary embodiments of the disclosure, FIG. 3 is a flowchart illustrating a process of determining a state of a traffic light by a telematics server according to exemplary embodiments of the disclosure, FIG. 4 is a view for describing a second vehicle adjacent to an intersection when there is the intersection on a driving path of a first vehicle, according to exemplary embodiments of the disclosure, FIG. 5 is a view for describing a case in which a second vehicle is a plurality of vehicles, according to exemplary embodiments of the disclosure, and FIG. 6 is a view illustrating a display for outputting status information of a traffic light.

Referring to FIG. 2, the first telematics terminal 110 mounted within the first vehicle 100 and be configured to output the driving path to the destination of the first vehicle 100 may be configured to transmit a signal for requesting status information of the traffic light 400 installed at the intersection located along the driving path to the driving path to the telematics server 300 (500). In particular, the intersection located along the driving path of the first vehicle 100 may refer to all intersections that the first vehicle 100 must pass to reach the destination, and may refer to intersections where the distance from the first vehicle 100 to the intersection is closest (e.g. a closest intersection).

In the present disclosure, for convenience of description, the intersection closest to the driving path of the first vehicle 100 will be described as the intersection located along the driving path of the first vehicle 100. Although not illustrated in the drawing, when there is a database for the status information of the traffic light 400 installed at the intersection located along the driving path of the first vehicle 100, the telematics server 300 may be configured to transmit the status information of the traffic light 400 installed at the intersection to the first telematics terminal 110.

When there is no the database for the status information of the traffic light 400 installed at the intersection, the telematics server 300 may be configured to search for another vehicle near to the intersection (520). In particular, another vehicle may refer to a vehicle having a telematics terminal (e.g., the second vehicle). In addition, another vehicle close to the intersection may refer to another vehicle (hereinafter referred to as 'the second vehicle 200') that is driving in the intersection direction when the distance from the intersection located along the driving path of the first vehicle 100 is less than or equal to the preset distance.

The second vehicle 200 may include a plurality of vehicles, and the telematics server 300 may be configured to preferentially select another vehicle having the same driving direction at the intersection as the first vehicle 100 as the second vehicle 200. In other words, a plurality of surrounding vehicles may be considered for communication and one out of the vehicles may be selected based on driving path and proximity to the intersection. For example, when the first vehicle 100 intends to drive straight at the intersection based on the driving path of the first vehicle 100, the second vehicle 200 may be selected as a vehicle having a same driving path going straight at the intersection.

Referring to FIG. 4, the first vehicle 100 is to be driven straight at the intersection 1 km ahead of the driving path. In particular, the telematics server 300 may be configured to select the second vehicle 200 having the driving path straight at the intersection. Thereafter, as described below, the status information of the traffic light 400 may be determined based on the speed information of the second vehicle 200. In other words, by selecting the second vehicle as a vehicle having a same driving path through the intersection, the speed information of the second vehicle may be used to determine the state of the light at the intersection.

Referring to FIG. 5, the second vehicle 200 in which the distance from the intersection located along the driving path of the first vehicle 100 is equal to or less than the preset distance and is driving in the intersection direction may include both a vehicle 200-1 located in a first lane and a vehicle 200-2 located in a second lane.

When the first vehicle 100 intends to drive straight at the intersection, the second vehicle 200 may be selected as a vehicle having a straight path of the vehicle 200-1 located in the first lane and the vehicle 200-2 located in the second lane. For example, when both the vehicle 200-1 located in the first lane and the vehicle 200-2 located in the second lane have the straight path, both the vehicle 200-1 located in the first lane and the vehicle 200-1 located in the second lane may be selected as the second vehicle 200 (e.g., or may be referred to as a first lane second vehicle and a second lane second vehicle). On the other hand, when the vehicle 200-1 located in the first lane has a left turn path, and the vehicle 200-2 located in the second lane has a straight path, the vehicle 200-2 located in the second lane may be selected as the second vehicle 200.

When the telematics server 300 selects the second vehicle 200, the telematics server 300 may be configured to transmit a signal for requesting speed information of the second vehicle 200 to the second telematics terminal 210 mounted within the second vehicle 200. (540). When the second telematics terminal 210 receives a signal for requesting speed information of the second vehicle 200 from the telematics server 300, the second telematics terminal 210 may be configured to transmit the speed information of the second vehicle 200 to the telematics server 300. (560).

At this time, the second telematics terminal 210 may be configured to transmit the speed information of the second vehicle 200 and all information related to the driving of the second vehicle 200 such as the current position information and the driving path of the second vehicle 200 to the telematics server 300. When the telematics server 300 receives the speed information of the second vehicle 200 from the second telematics terminal 210, the telematics server 300 may be configured to determine the state of the traffic light 400 installed at the intersection based on the speed information received from the second telematics terminal 210 (580).

In particular, referring to FIG. 3, the telematics server 300 may be configured to determine whether the speed of the second vehicle 200 is greater than or equal to a preset speed (581). When the speed of the second vehicle 200 is greater than or equal to the preset speed, the telematics server 300 may be configured to determine the state of the traffic light 400 installed at the intersection as a green light state (582). In other words, the second vehicle 200 drives at the preset speed or greater may indicate that the traffic light 400 is a green light. The preset speed may be about 20 km/h, and may be set without limitation as long as the speed is a standard of low speed driving.

Thereafter, the telematics server 300 may be configured to determine whether the second vehicle 200 stops before passing through the intersection (583). Even if the second vehicle 200 drives at the preset speed or greater before passing through the intersection, when the traffic light 400 changes from the green light state to a red light state, the second vehicle 200 may stop before passing through the intersection. When the second vehicle 200 does not stop before passing the intersection (NO in 583), the state of the traffic light 400 may be determined to be the green light state. However, when the second vehicle 200 stops before passing the intersection (YES in 583), the telematics server 300 may be configured to change the traffic light 400 state to the red light state (584).

While the second vehicle 200 has driven at a speed greater than the preset speed and stopped before passing through the intersection, it may indicate that the traffic light 400 has changed to a red light. When the speed of the second vehicle 200 is less than the preset speed (NO in 581), the telematics server 300 may be configured to determine whether the intersection corresponds to a congestion section based on traffic information of the intersection received from an external traffic information server (585). When the intersection section is determined to be the congestion section (YES in 585), the telematics server 300 may be configured to determine the state of the traffic light 400 installed at the intersection as an unknown state (586).

In particular, it may not be possible to determine whether the second vehicle 200 is driving at a slower speed than the preset speed due to the traffic congestion, or whether the second vehicle 200 is driving at a slower speed than the preset speed due to the traffic light 400 of the intersection is the red light. The congestion section may refer to a situation in which an average speed of vehicles passing through the intersection section is less than or equal to the preset speed.

When the intersection section is not the congestion section (NO in 585), the telematics server 300 may be configured to determine the state of the traffic light 400 installed at the intersection based on an acceleration of the second vehicle 200. Particularly, the telematics server 300 may be configured to determine whether the second vehicle 200 decelerates (590). When the second vehicle 200 decelerates (YES in 590), the telematics server 300 may be configured to determine the state of the traffic light 400 installed at the intersection as the red light state (591).

The intersection section is not congested and the second vehicle 200 is driving at a low speed, but the decrease in the speed of the second vehicle 200 may indicate that the traffic light 400 is the red light. When the second vehicle 200 does not decelerate (NO in 590), the telematics server 300 may be configured to determine whether the second vehicle 200 accelerates to have a speed greater than the preset speed (592). Thereafter, when the second vehicle 200 accelerates to have a speed equal to or greater than the preset speed (YES in 592), the telematics server 300 may be configured to determine the state of the traffic light 400 installed at the intersection as the green light state (593). Since the second vehicle 200 drives at a low speed while increasing the speed, the situation may indicate that the traffic light 400 is the green light.

Although not illustrated in the drawing, the telematics server 300 may be configured to update the database by storing information regarding the determined state of the traffic light 400 in the database. For example, when the state of the traffic light 400 is determined, the telematics server 300 may be configured to accumulate information regarding the state of the traffic light 400 in the database by counting a holding time of the traffic light 400 from the determined point.

In addition, when the telematics server 300 stops before the second vehicle 200 passes through the intersection (YES in 583), the telematics server 300 may be configured to determine a stop point of the second vehicle 200 as a point at which the state of the traffic light 400 installed at the intersection is changed to the red light state, determine a point (YES in 592) at which the speed of the second vehicle 200 becomes greater than or equal to a threshold speed as the point at which the state of the traffic light 400 installed at the intersection is changed to the green light state, determine the holding time of the red light state and the green light state based on the point at which the state of the traffic light 400 installed at the intersection is changed to the red light state, and store information regarding the holding time of the red light state and the green light state in the database.

In addition, when the straight signal of the traffic light 400 located along the driving direction of the first vehicle 100 and the second vehicle 200 is the green light, the telematics server 300 may be configured to determine that the traffic light 400 installed at the intersection of a direction perpendicular to the driving direction of the first vehicle 100 and the second vehicle 200 as the red light, and may be configured to store, in the database, the status information of the traffic light 400 installed at the intersection of the direction perpendicular to the driving direction of the first vehicle 100 and the second vehicle 200.

Referring to FIG. 2, the telematics server 300 may be configured to transmit information regarding the state of the traffic light 400 installed at the intersection to the first telematics terminal 110 (600). The information regarding the state of the traffic light 400 installed at the intersection may include information regarding a color of the traffic light 400 and information regarding the red or green light holding time of the traffic light 400. When the first telematics terminal 110 receives information regarding the state of the traffic light 400 installed at the intersection from the telematics server 300, the first telematics terminal 110 may be configured to output the received status information of the traffic light 400 to the display (610).

Referring to FIG. 6, the first telematics terminal 110 may be configured to display, on the display, a time remaining for changing the state of the traffic light 400 (and/or the time that the state of the traffic light 400 is maintained) and the state of the traffic light 400 at the intersection along with a turn-by-turn (TBT) indication indicating the driving direction at the intersection and/or a remaining distance to the intersection.

For example, when the traffic light 400 installed at the intersection of 1 km ahead is determined to be the green light and a time remaining for changing the green light to the red light is determined to be 5 seconds, the first telematics terminal 110 may be configured to display a color of a circle icon 111 in green, and may be configured to display a phrase "5 seconds" next to the circle icon 111. Similarly, when a left turn indication of the traffic light 400 installed at the intersection located at 1.5 km ahead after the straight at the intersection of 1 km ahead is determined to be the red light and the time remaining for changing the red light to the green light is determined to be 10 seconds, the first telematics terminal 110 may be configured to display the color of the circle icon 111 in red, and may display a phrase "10 seconds" next to the circle icon 111.

According to the intersection signal prediction system and the method thereof described above, there is an advantage that a database for the traffic light of the intersection may be formed based on the driving state of another vehicle even when the database for the traffic light of the intersection does not exist. In addition, it may be possible to increase the driving convenience by allowing the driver to know the signal of a next intersection, thereby improving the fuel efficiency of the vehicle by determining whether the driver increases or decreases the vehicle. In particular, the present disclosure may be more effective when the traffic lights at the forward intersections deviate from the driver's viewable area.

When the intersection signal prediction system according to the exemplary embodiments is applied to an autonomous vehicle, the autonomous vehicle may be configured to adjust the speed of the vehicle according to the next intersection signal. According to the exemplary embodiments of the disclosure, by informing the driver in advance of the signal information of the intersection located along the driving path, the driver may determine in advance whether to increase or decrease the speed of the vehicle before reaching the intersection, thereby increasing driving convenience, improving fuel economy of the vehicle, and improving driver safety.

Exemplary embodiments of the disclosure have thus far been described with reference to the accompanying drawings. It will be obvious to those of ordinary skill in the art that the disclosure may be practiced in other forms than the exemplary embodiments as described above without changing the technical idea or essential features of the disclosure. The above exemplary embodiments are only by way of example, and should not be interpreted in a limited sense.

What is claimed is:

1. An intersection signal prediction system, comprising:

a first telematics terminal mounted within a first vehicle, and configured to output a driving path toward a destination of the first vehicle;

a second telematics terminal mounted within a second vehicle driving in a direction toward an intersection located along the driving path of the first vehicle, wherein a distance between the second vehicle and the intersection is equal to or less than a preset distance; and a telematics server configured to communicate with the first telematics terminal and the second telematics terminal, wherein the first telematics terminal is configured to transmit a signal requesting status information of a traffic light installed at the intersection located along the driving path to the telematics server, and wherein the telematics server is configured to:

in response to receiving the signal for requesting the status information of the traffic light installed at the intersection from the first telematics terminal, transmit a signal to the second telematics terminal requesting speed information of the second vehicle;

determine a state of the traffic light installed at the intersection based on the speed information received from the second telematics terminal; and transmit information regarding the state of the traffic light to the first telematics terminal, wherein the first telematics terminal is further configured to:

display a plurality of TBT (turn-by-turn) indications respective to a plurality of intersections located along the driving path; and display a plurality of visual indications representing the state of the traffic light respective to the plurality of TBT indications based on the information regarding the state of the traffic light.

2. The intersection signal prediction system according to claim 1, wherein, when there is a database of status information of the traffic light installed at the intersection, the telematics server is configured to transmit the status information of the traffic light installed at the intersection to the first telematics terminal based on data within the database.

3. The intersection signal prediction system according to claim 1, wherein, when a speed of the second vehicle is greater than or equal to a preset speed, the telematics server is configured to determine the state of the traffic light installed at the intersection as a green light state.

4. The intersection signal prediction system according to claim 3, wherein, when the second vehicle stops before passing through the intersection, the telematics server is configured to change the state of the traffic light to a red light state.

5. The intersection signal prediction system according to claim 1, wherein, when a speed of the second vehicle is less than a preset speed, the telematics server is configured to determine the state of the traffic light installed at the intersection based on an acceleration of the second vehicle.

6. The intersection signal prediction system according to claim 5, wherein, when the second vehicle decelerates, the telematics server is configured to determine the state of the traffic light installed at the intersection as a red light state.

7. The intersection signal prediction system according to claim 5, wherein, when the second vehicle accelerates to have a speed greater than the preset speed, the telematics server is configured to determine the state of the traffic light installed at the intersection as a green light state.

8. The intersection signal prediction system according to claim 5, wherein the telematics server is configured to:

receive traffic information of the intersection from an external traffic information server; and when the intersection corresponds to a congestion section, determine the state of the traffic light installed at the intersection as an unknown state.

9. The intersection signal prediction system according to claim 1, wherein the telematics server is configured to store information regarding the state of the traffic light in a database.

10. An intersection signal prediction method, comprising:

transmitting, by a first telematics terminal mounted within a first vehicle, a signal requesting status information of a traffic light installed at an intersection located along a driving path of the first vehicle to a telematics server;

receiving, by the telematics server, speed information of a second vehicle from a second telematics terminal mounted within the second vehicle driving in a direction to an intersection located along the driving path of the first vehicle, wherein a distance between the second vehicle and the intersection is equal to or less than a preset distance;

determining, by the telematics server, a state of the traffic light installed at the intersection based on the speed information received from the second telematics terminal; and transmitting, by the telematics server, information regarding the state of the traffic light to the first telematics terminal, wherein the method further comprises:

displaying, by the first telematics terminal, a plurality of TBT (turn-by-turn) indications respective to a plurality of intersections located along the driving path; and displaying, by the first telematics terminal, a plurality of visual indications representing the state of the traffic light respective to the plurality of TBT indications based on the information regarding the state of the traffic light.

11. The intersection signal prediction method according to claim 10, wherein, when there is a database of status information of the traffic light installed at the intersection, transmitting, by the telematics server, the status information of the traffic light installed at the intersection to the first telematics terminal based on the database.

12. The intersection signal prediction method according to claim 10, wherein the determining of the state of the traffic light installed at the intersection based on the speed information received from the second telematics terminal includes:

when a speed of the second vehicle is greater than or equal to a preset speed, determining the state of the traffic light installed at the intersection as a green light state.

13. The intersection signal prediction method according to claim 12, wherein the determining of the state of the traffic light installed at the intersection based on the speed information received from the second telematics terminal includes:

when the second vehicle stops before passing through the intersection, changing the state of the traffic light to a red light state.

14. The intersection signal prediction method according to claim 10, wherein the determining of the state of the traffic light installed at the intersection based on the speed information received from the second telematics terminal includes:

when a speed of the second vehicle is less than a preset speed, determining the state of the traffic light installed at the intersection based on an acceleration of the second vehicle.

15. The intersection signal prediction method according to claim 14, wherein, when the speed of the second vehicle is less than the preset speed, the determining of the state of the traffic light installed at the intersection based on the acceleration of the second vehicle comprises:

when the second vehicle decelerates, determining the state of the traffic light installed at the intersection as a red light state.

16. The intersection signal prediction method according to claim 14, wherein, when the speed of the second vehicle is less than the preset speed, the determining of the state of the traffic light installed at the intersection based on the acceleration of the second vehicle includes:

when the second vehicle accelerates to have a speed greater than the preset speed, determining the state of the traffic light installed at the intersection as a green light state.

17. The intersection signal prediction method according to claim 14, wherein, when the speed of the second vehicle is less than the preset speed, the determining of the state of the traffic light installed at the intersection based on the acceleration of the second vehicle comprises:

receiving, by the telematics server, traffic information of the intersection from an external traffic information server; and when the intersection corresponds to a congestion section, determining the state of the traffic light installed at the intersection as an unknown state.

18. The intersection signal prediction method according to claim 10, further comprising:

storing, information regarding the state of the traffic light in a database of the telematics server.

* * * * *